US012097398B2

(12) United States Patent
Hetrick et al.

(10) Patent No.: US 12,097,398 B2
(45) Date of Patent: Sep. 24, 2024

(54) EXERCISE SYSTEM FOR USING VARIABLE LOCATION ANCHORS AND VARIABLE BIASING ELEMENTS, AND METHOD OF USE THEREOF

(71) Applicant: FITNESS ANYWHERE LLC, Walnut Creek, CA (US)

(72) Inventors: Randal A. Hetrick, San Francisco, CA (US); Mauricio Hernan Delgado, South Jordan, UT (US)

(73) Assignee: JFXD TRX ACQ LLC, Delray Beach, FL (US)

( * ) Notice: Subject to any disclaimer, the term of this patent is extended or adjusted under 35 U.S.C. 154(b) by 84 days.

(21) Appl. No.: 17/618,237

(22) PCT Filed: Jun. 12, 2020

(86) PCT No.: PCT/US2020/037443
§ 371 (c)(1),
(2) Date: Dec. 10, 2021

(87) PCT Pub. No.: WO2020/252268
PCT Pub. Date: Dec. 17, 2020

(65) Prior Publication Data

US 2022/0257990 A1 Aug. 18, 2022

Related U.S. Application Data

(60) Provisional application No. 62/860,477, filed on Jun. 12, 2019.

(51) Int. Cl.
*A63B 21/04* (2006.01)
*A63B 21/00* (2006.01)
(Continued)

(52) U.S. Cl.
CPC ..... *A63B 21/0442* (2013.01); *A63B 21/0557* (2013.01); *A63B 21/169* (2015.10); *A63B 21/4035* (2015.10)

(58) Field of Classification Search
CPC ..... A63B 21/0442; A63B 21/0557; A63B 21/169; A63B 21/4035; A63B 21/4019;
(Continued)

(56) References Cited

U.S. PATENT DOCUMENTS 3,618,942 A 11/1971 Bates et al.
7,090,622 B2 * 8/2006 Hetrick ..... A63B 23/16 482/141

(Continued)

FOREIGN PATENT DOCUMENTS

DE 102014012263 A1 2/2016

OTHER PUBLICATIONS

International Search Report and Written Opinion for corresponding PCT Application Serial No. PCT/US2020/037443 mailed Oct. 15, 2020.

(Continued)

*Primary Examiner* — Andrew S Lo
(74) *Attorney, Agent, or Firm* — Duane Morris LLP

(57) ABSTRACT

The present invention generally relates to a system for exercise using a set of mounting plates attached to a surface capable of being modulated as to both the number and location of anchor points, the use of shortening elements to quickly vary the effective length of a set of biasing elements to allow a user, holding one or more exercise attachments to perform exercises in the aerobic, the strength, the flexibility, and in the balance areas. The system allows for easy class dynamics as users can quickly reconfigure the system using one or many of snap-connects The system allows for hundreds of different exercises to be performed, a rapid transi-
(Continued)

tion between exercise, a simple method to target specific muscle groups at specific angles of exercise to create a full body experience.

17 Claims, 14 Drawing Sheets

(51) Int. Cl.
*A63B 21/055* (2006.01)
*A63B 21/16* (2006.01)

(58) Field of Classification Search
CPC ..... A63B 71/0036; A63B 2071/009; A63B 2071/0625; A63B 2071/0694; A63B 2209/08; A63B 2209/10; A63B 2225/09; A63B 2225/10; A63B 21/02; A63B 21/04; A63B 21/055; A63B 21/16
See application file for complete search history.

(56) References Cited

U.S. PATENT DOCUMENTS 7,625,325 B1 12/2009 Yost
8,690,742 B1 4/2014 Herman et al.
9,050,493 B2 * 6/2015 Perez ..... A63B 21/0442
9,802,072 B2 * 10/2017 Wehrell ..... A63B 21/4013
10,391,356 B2 * 8/2019 Davis ..... A63B 21/0557
2003/0186792 A1 10/2003 Keeler
2011/0237410 A1 * 9/2011 Perez ..... A63B 21/16 482/129
2014/0141946 A1 * 5/2014 Huber ..... A63B 23/1209 482/110
2015/0238799 A1 8/2015 Arline
2017/0128769 A1 5/2017 Long et al.
2017/0182349 A1 6/2017 DiMartino
2018/0021622 A1 1/2018 Holland et al.
2020/0078628 A1 * 3/2020 Parise ..... A63B 21/0557
2021/0299505 A1 * 9/2021 Carrafield ..... A63B 21/4021
2022/0176187 A1 * 6/2022 Falahi ..... A63B 21/08

OTHER PUBLICATIONS

Extended European Search Report issued for corresponding European Patent Application No. 20822343.8 dated Jun. 2, 2023, 8 pages.

* cited by examiner

EXERCISE SYSTEM FOR USING VARIABLE LOCATION ANCHORS AND VARIABLE BIASING ELEMENTS, AND METHOD OF USE THEREOF

CROSS-REFERENCE TO RELATED APPLICATIONS

This application claims priority under 35 U.S.C. § 119(e) to International Patent Application Serial No. PCT/US2020/037443 filed on Jun. 12, 2020 entitled EXERCISE SYSTEM FOR USING VARIABLE LOCATION ANCHORS AND VARIABLE BIASING ELEMENTS, AND METHOD OF USE THEREOF which claims priority to U.S. Provisional Patent Application Ser. No. 62/860,477 filed on Jun. 12, 2019, the entire contents of which are incorporated herein by reference.

TECHNICAL FIELD

The present invention generally relates a new system for user-power exercise using a set of mounting plates attached to a surface capable of being modulated as to both the number and location of anchor points and the effective length of biasing elements to allow a user, holding one or more exercise attachments to perform exercises in the aerobic, the strength, the flexibility, and in the balance areas. The system allows for class dynamics and full body workouts after performing a wide range of exercises.

BACKGROUND

There are four types of physical exercises, the first is aerobic exercises designed to increase your breathing and heart-rate and is often used as the overall main component of most fitness programs or the warm up phase for other types of fitness exercise. Aerobic exercises include jogging, walking, climbing stairs, or sports like swimming, running, playing tennis, or dancing. Aerobic machines include the treadmill, the stair climber and the stationary bike. The second type of exercise is strength exercises. These are important for keeping bones and muscles strong and helping older adults maintain independence and bone density. Examples of strength exercises include lifting free weights, using resistance machines at a gym, or using the famous TRX® exercise bands invented by the inventor to leverage a person's own body weight to build strength. The third type of exercise is flexibility exercises are useful to help maintain good physical health, a limber body and a body able to move freely in its environment. For example, flexibility exercises include stretching or doing yoga and also a whole range of exercise using the inventor's famous TRX® Suspension Training®. The fourth and final type of exercises is balance known to help improve balance, strengthen core portions of an individual, and help with three-dimensional orientation and movement. For example, the practice of Tai Chi, standing on one foot or on a ball, or even walking heel-to-toe helps with balance. Once again, the famous TRX® line of products also includes these types of exercises. What is needed is a system designed to offer in a single product a whole range of exercises in as many of these types as possible.

As one can imagine, everyone from the professional athlete to the person in physical rehabilitation from an injury faces the task of learning from each of these different types of exercises, learning of numerous equipment used to perform these four types of exercises, and more importantly manage a schedule and work-out location to be able to take full benefit from such complex notions. For example, around towns, gyms have popped-up where some of this equipment is collected and assembled and also where service providers such as trained assistants and coaches can use the equipment to better meet the different needs of customers and users. But as one can imagine, machines often target a single muscle group, require maintenance, are bulky and costly. Centers for rehabilitation are also large, require extensive maintenance and pass on the cost to clients and patients. What is needed is a low cost system, that can be installed in a limited area to help service these needs.

The inventor also understands the value of training solutions able to either offer a wide range of exercise spanning, a system able to be used in a dynamic class environment, or even a low cost alternative to the use of numerous and bulky machines by private gyms. Shown as FIG. 1 from the prior art is an illustration of what the inventor now calls the RIP®. As illustrated, the SUSPENSION TRAINING® 3 is shown attached on a high point (above the user's head). The RIP is used by a person 1 by moving the person's shoulders 2. The RIP is attached at an anchor 4 on a vertical wall at around the altitude where the product must be used. The anchor 4 is often a bolted x-shaped anchor for the use of a carabineer-type connector. A user 1 as shown will hold a long stick 7 and using a long elastic band 5 connected to the tip 6. The user 1 can push and/or move the stick 7 in a circular motion. As one can imagine, the use of the product allows for a horizontal force to be created at the tip 6 of the stick 7 via the elastic resistance band 5. One of the most recognizable movements to be done with the RIP is a swing much like a baseball bat as the movement unfolds in its trajectory as illustrated at FIG. 1. This movement engages a swooping set of muscles in the back, the arms and the legs unlike what can be engaged using any other means. Some of the problems linked with the RIP as shown at FIG. 1 is a need to wisely and expertly control the position away from the anchor point to create the proper resistance in the elastic band, the need to have a large open space to conduct these large movements mainly because of the elastic band, and the notion that the number and variety of exercises to be conducted with this device is limited in many ways.

The inventor has invented and developed a sub-field of exercise known as SUSPENSION TRAINING® by TRX®. This technology the use of resistance bands 3 as shown at FIG. 1 and the gravity angles of a body. The inventor has applied and secured over the last decade multiple patents in the United States and around the world relating to this technology including U.S. Pat. Nos. 7,044,896, and 7,090,622 to name a few. One image of this product shown as 3 on FIG. 1 is reproduced at FIG. 2 from the prior art. Mr. Randall Hetrick recognizes how people exercise and how users leverage the different gyms, coaches, to sculpt a body. At the core of the product is one key limitation, resistance in the SUSPENSION TRAINING® results from gravity and weight of the body of the user. The product must often be attached or secured to a location above a person's head to allow the weight to place the product in traction. This is one key limitation of this type of technology the inventor has been working to overcome. What would be desirable is a new way to attach the totality or a portion of the TRX® SUSPENSION TRAINING® to a set of pre-set variable locations or to create a new experience which can reinforce this product.

Individual exercise equipment in the strength exercise area is heavy, bulky, and designed to focus on a single muscle group. A user sits in a very specific position, then adjust upon need a stack of variable weights. Using a pin and gravity, the user would select a fraction of the available maximum weight. Sitting at the machine, a single movement is strained at the proper angle, with the proper force for a set period of repetition. Using a person's own weight, the need for a stack of heavy weight could be circumvented. Also, Mr. Hetrick adapted the device so it could be used to perform a large number of exercises targeting a large number of muscles and muscle groups. In essence, he created a "gym in a bag" which revolutionized the exercise world. In many gyms, trainers are forced to alternate between using these machines and using an exercise ball to work other groups of muscles.

At the heart of training technology is the notion that certain elements are elastic and others are not elastic. An example of a non-elastic element includes a rope or a nylon strap which retains mostly the same length once a traction force is applied thereto. The technology of the SUSPENSION TRAINING® relies generally on inelastic flat straps. Recently U.S. Pat. No. 9,802,072 was granted to Mr. Michael A. Wehrell. He invented a semi-portable system designed to create a constant resistance on ropes pulled away from a box. FIG. 27 from this patent is reproduced as FIG. 3. This system operates the same way as a crank start of a lawnmower or a snowmobile, where a user pulls away from the box a rope that unrolls over a pulley-based system designed to creating a fixed level of resistance force on a user irrespective of the distance from the source. The images show how a runner may be attached to the Wehrell device during run trainings. In this device, different body parts of a runner are attached and using pulleys the ropes are managed. One can easily understand, this system is fragile, offers very little flexibility and internal pulleys can stop operating and prevent use.

In a different invention shown as U.S. Pat. No. 9,050,493 teaches a station mounted on a wall with multiple plates made of hooks in different orientations as FIG. 4 from the prior art. A person uses a normal elastic band with two handles and tries to use the different hooks located on different pieces in a way which allows the person to change the height and angle in the resistance of the band. This system as shown is bulky as the wall mounted system is heavy and expensive to produce. The system also uses multiple hooks which can be dangerous in an open-area gym and as the elastic bands is used, it may break and hurt the user. Other clear disadvantages of this system is the use of handles or a two hand hold to connect the band to the wall.

Historically, the RIP TRAINER® shown at FIG. 1 and its technology has been widely commercialized but it generally is perceived as a single-use product, designed mostly for a single-set of movements. While it can be used in multiple different configurations, most users will hesitate to acquire this solution. Also, while several key exercises can be performed, it does not offer the capacity to be used in a class setting for a full hour during a class-instructed environment.

Using normal stacks of weights or ropes, a person sets a fixed weight (i.e. 50 lbs) and as the exercise is performed, the weight and force remains constant. One of the problems with fixed force exercise is that a muscle might be stronger in certain angles while weaker at others in any given range of motion. In contrast, gyms often provide a set of elastic bands with two end handles or closed O-shaped bands. To vary the resistance offered by these bands, the type of elastic band will be varied. For example, a set of different color bands can be sold commercially, the red being a fixed force per inch, the second twice the force for an elongation of one inch. What most do not understand is that the strain or return force created in the user's muscles by moving the tip of a biasing element varies as it increases in distance using Hoke's law. As a reminder, this important law is given by:

$$F=k*\Delta L$$

Where F is the force upon a user's body, k is a proportionality constant that depends on the shape and composition of the elastic member and ΔL is the variation in length of the elastic member. In essence, the greater the deformation of the elastic member, the greater the force felt by the user. The problem associated with Hooke's law when exercising is this understanding that a movement during exercise has a start (A) and an end point (B) and that movement between both of these points result in: $B-A=\Delta L$ So a coach will have to understand that unlike in strap-based exercise or other type of strength exercise, the created resistance on a muscle or a group will evolve and increase as the movement is performed. A coach must measure a starting point, an end point, and try to regulate angles, distances, or the type of band (k) to optimize the exercise. For example, in the case of a baseball bat swing, a person may need a larger effort in the back of the swing requiring initial gyration or the start A located closer away from a point. In the case of a swim stroke, where the movement is completely different, the system cannot be adapted from a baseball swing to a swim stroke. As a consequence, the current use of this technology allows a person to work on torsion generally, angled groups of muscles. Said more simply, if an arm moves 24 inches in a given exercise, on a normal inelastic set, the force F may be 50 lbs from the first inch to the last. Using Hooke's law, if the force on a biasing element is 2 lbs per inch, the first inch will see a force of 2 lbs only while the last inch will see a force of 48 lbs (i.e. 24 inch×2 lbs/in). Since a minimum resistance should be placed on muscles during the entire cycle of exercise, in the context of exercising with a biasing element, the biasing element could be initially pre-tensed (i.e. the movement can be made to start at inch 10) so the start of the exercise has 20 lbs and the end would have 68 lbs (i.e. 20 lbs+(24 inch×2 lbs/in).

While in initial stages of deformation Hooke's Law can be faithfully found, once a certain threshold has been passed, the band will deform less for a greater increase in force on the user. Finally, past a plastic deformation point, damage will be done to the element which will not return to the initial length. Finally, if pulled enough, any band will break. Once again, coaches adapt to these problems by calibrating movements, changing the band length, or asking a user to hold the staff at a different location.

What is needed is a new version of the RIP that is more adapted to a rapid adaptation and variability of the proportionality constant (k) to greatly increase the strength for multiple users, increase the number of effective ranges of exercises, and more importantly be able to control the length (ΔL) needed for exercise and thus better control the effective footprint of the system. The inventor, more than anyone in the field, understands that users of products greatly desire versatility and the capacity to conduct a whole range of exercises with a single device. Also, movements of such a staff may result, in confined spaces such as hotel rooms or smaller training areas in damage to the environment as the staff is moved to help find the appropriate force and angle of exercise. What is needed is a system designed for use in a compact environment or a system that takes into consideration these inherent special limitations and leverages them appropriately to help provide the system a greater value. Finally, what is also needed is a system capable of being transformed from being a piece of equipment designed to help focus and train specific segments of a body into system capable of being used to train larger portions of a user's body or better yet to be used in a class or dynamic training environment.

SUMMARY

The present invention generally relates to a new system for exercise using a set of mounting plates attached to a surface capable of being modulated as to both the number and location of anchor points, the use of shortening elements to quickly vary the effective length of a set of biasing elements to allow a user, holding one or more exercise attachments to perform exercises in the aerobic, the strength, the flexibility, and in the balance areas. The system allows for easy class dynamics as users can quickly reconfigure the system using one or many of snap-connects, move their position on the floor in front of the mounting plates. The system allows for hundreds of different exercises to be performed, a rapid alternation between exercise, a simple method to target specific muscle groups at specific angles of exercise to create a full body experience. Also, the system is designed with no weights, no heavy or bulky features and can at very low cost be purchased and installed in most existing locations.

In one embodiment in accordance with the present disclosure, an exercise system for performing exercises adjacent to a surface by at least a user by creating a resistance force in a portion of the user's body by pulling at least one exercising element away from the surface is provided. The system includes first and second mounting points fixed on the surface, each of the first and second mounting points including at least one shortening element and a first mating connector. The system can also include a biasing element comprising a proximate end and a distal end and a length therebetween. The biasing element can be configured to pass through the at least one shortening element on one of the first and second mounting points and the distal end can be removably coupled to the first mating connector on one of the first and second mounting points. The system can further include at least one user interface removably coupled to the proximate end of the biasing element. An intermediate portion of the biasing element located between the proximate end and the distal end can be configured to slide in the at least one shortening element and serves to alter a resistance vector at the user interface during use.

In one aspect of the present disclosure, the first and second mounting points comprise first and second mounting plates, respectively.

In another aspect, the system can further include a third mounting point comprising a third mounting plate to form a three by three matrix of anchor points.

In another aspect, the surface is a vertical wall and the mounting plates each include an attachment for securing each plate to the vertical wall either horizontally or vertically.

In another aspect, the user interface is selected from a group comprising, a strap based exercise trainer device, a strap-based handle, a partly wooden handle, a loop with a carabineer, a belt attachment, and a shoulder strap attachment.

In another aspect, either the first mating connector or the user interface can include either a quick-connect or a carabineer.

In another aspect, the shortening element for sliding movement of the biasing element in the anchor is selected from the group of a smooth rounded surface, a surface with friction rollers, a rope guide with funnel, a bearing-based friction redactor, a Teflon®-coated transfer segment.

In another aspect, the exercise system can include a plurality of biasing elements each adapted to be removably coupled to different locations on the mounting points.

In another aspect, the plurality of biasing elements has different variable resistance to elongation or are of different lengths.

In still another aspect, the exercise system can include a stand for holding a guide for exercising and using of the system.

In another example in accordance with the present disclosure, a method of using an exercise system for performing exercises next to a surface is provided. The method can include the steps of mounting upon a surface at least two mounting points, wherein each mounting point includes at least an opening for the passage and sliding movement of at least one biasing element, and a first mating connector to receive a distal end of the at least one biasing element. The method can also include attaching at least one user interface to a proximate end of the at least one biasing element and sliding the distal end of the at least one biasing element through the at least one opening of the mounting point. The method can also include attaching the distal end of the at least one biasing element to one of the first mating connectors. During use of the system and the related method can also include articulating the user interface relative to the mounting surface in a direction generally away from the surface to create a variable resistance via variable deformation of a length of the biasing element, wherein a resistance vector felt by a user articulating the user interface is modulated by a resistor vector at the other of the distal end of the at least one biasing element.

In one aspect, the exercise system has a vertical wall as a surface and the mounting plates include an attachment for securing each plate to the vertical wall either horizontally or vertically, and the method includes the step of mounting the plates and also securing to a wall in proximity a rack and accessories for use by the method.

In another example in accordance with the present disclosure, a method of using an essentially vertical exercise system is provided. The method may include providing an exercise system. The exercise system can include a base plate mounted on an essentially vertical surface with multiple attachment points and at least one elastic band with a first end for connection to at least one of the multiple attachment points and the other end for applying a pulling force, wherein at least one of the multiple attachment points comprises a substantially rounded bracket defining an opening. The method can include attaching the base plate to an essentially vertical surface and attaching the at least one elastic band to one of the multiple attachment points on the base plate. The method can also include threading the at least one elastic band through the substantially rounded bracket and applying a force to an end of the elastic band in a direction generally away from the base plate.

In yet another example in accordance with the present disclosure, another method of using an essentially vertical exercise system is provided. The method may include providing an exercise system. The exercise system can include a base plate mounted on an essentially vertical surface with multiple attachment points and at least one elastic band having a fixed length with a first resistance with a first end for connection to at least one of the multiple attachment points and a second end for applying a pulling force. The method may also include attaching the base plate to an essentially vertical surface and attaching the first end of the at least one elastic band to the base plate using a quick-connect at one of the multiple attachment points on the base plate. The method may also include applying a first force to the second end of the elastic band at the first resistance and threading the at least one elastic band through at least one other attachment point on the base plate for shortening the effective exercising length of the elastic band to create a second resistance, wherein the second resistance is greater than the first resistance. The method may also include applying a second force to the second end of the elastic band at the second resistance.

In yet another example in accordance with the present disclosure, a method of using an essentially vertical exercise system is provided. The method includes providing an exercise system, the exercise system comprising a base plate with multiple female quick-connectors and at least one elastic band having a fixed length with a first end with a male quick-connector and a second end for applying a pulling force. The method further includes attaching the base plate to an essentially vertical surface and attaching the first end of the at least one elastic band to one of the multiple female quick-connectors on the base plate. The method may also include applying a force to the second end of the elastic band for exercising in a first configuration and removing the male quick-connector from the one of the multiple female quick-connectors to disconnect the at least one elastic band from the base plate. The method may also include attaching the at least one elastic band at the first end using the male quick-connector to a different one of the multiple female quick-connectors on the base plate and applying a force to the second end of the at least one elastic band for exercising in a second configuration.

In still another example in accordance with the present disclosure, a process of installation on a virtually vertical surface of an exercise system is provided. The process may include providing an exercise system. The exercise system can include at least two base plates for mounting on an essentially vertical surface, each base plate with multiple attachment points and at least one elastic band with a first end for connection to at least one of the multiple attachment points and a second end for applying a pulling force. The at least one of the multiple attachment points can include one of a substantially rounded bracket, a male quick-connect or a female quick-connect. The process may also include attaching a first of the at least two base plates to the essentially vertical surface and attaching a second of the at least two base plates to the essentially vertical surface in close proximity to the first base plate. The process may also include attaching the at least one elastic band to one of the plurality of attachment points on the base plate via either the substantially rounded bracket, the male quick-connect or the female quick-connect.

DETAILED DESCRIPTION

The current invention is one described as part of the field of exercising generally and also described in terminology linked with products generally found in modern gyms. But historically, such products have had a much wider audience than simply the people who desire to exercise. For example, the military has extensive programs directed at making sure troops are ready, well trained and well-conditioned including physical conditioning. While not explicitly described as such, one of ordinary skill will understand that this new invention and its teachings can as easily be extended to apply to the military. Also, one other key group which has an extensive need of this technology is the medical therapeutic and rehabilitation area. When individuals have issues with specific groups of muscles, they may be required to perform routinely certain very specific sets of exercise. This invention relates to a new system and apparatus specifically designed to be adapted easily as to resistance, strength, angle, and the way it can be used. Nursing homes and other centers for those facing any type of physical challenge also can use this type of technology. For example, one can conceive using one of the wall mounted pieces on hospital or nursing homes next to a bed. Using this technology, a bed-struck individual may still be able to do at leisure certain upper body exercise to tone and maintain the lower back which often will be severely distressed during extended bedrests.

Other uses also include micro-gravity environments or even underwater environment. Weight training is almost impossible to operate in micro-gravity environments and the classic body weight strap system cannot be used without gravity or under water in a pool, this technology can easily be placed inside of a pool for use to help with aqua aerobics to incorporate some level of non-aerobic exercise. What is contemplated is the use of this technology in any location where a wall or flat surface can be used next to some open area where a person can train.

Figure 1:
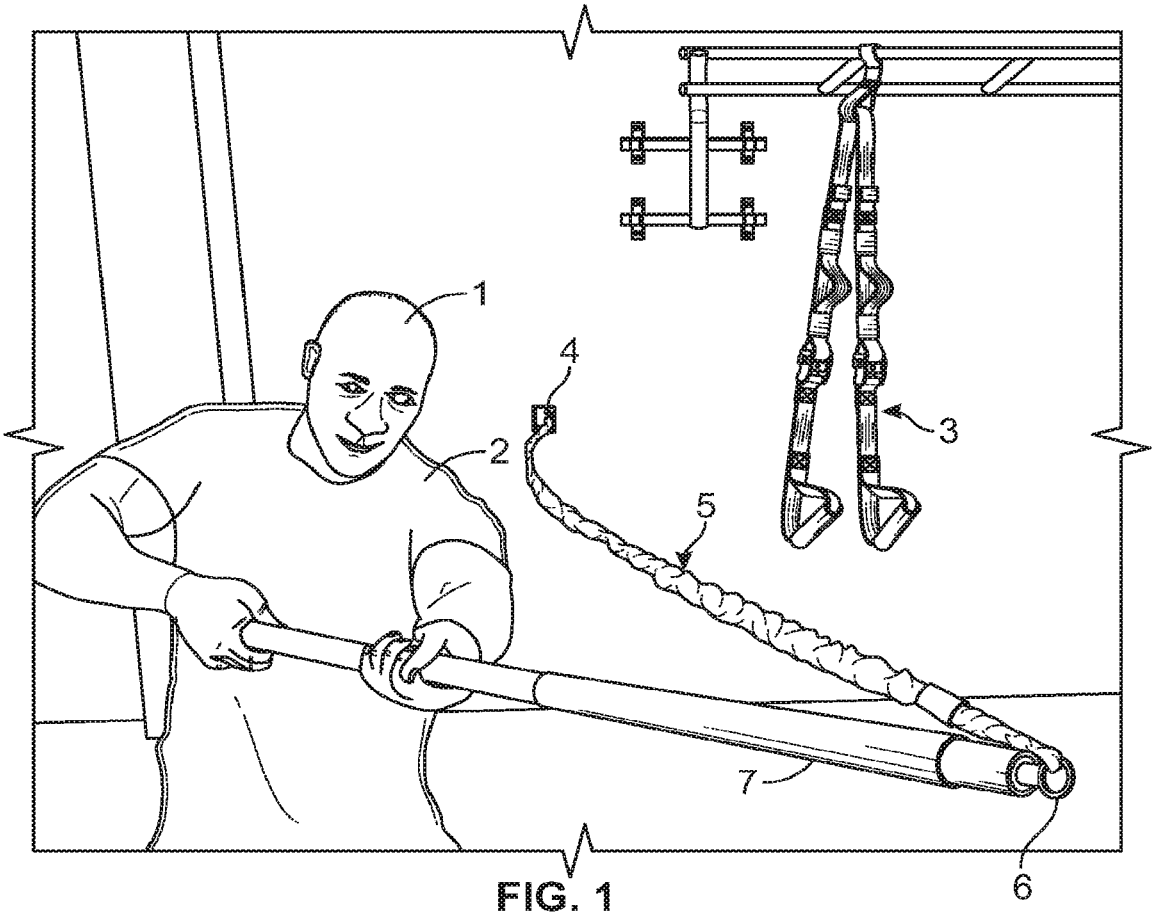
FIG. 1 (Prior Art)
FIG. 1 is an illustration from the prior art showing both the RIP® and the SUSPENSION TRAINING® as used in a gym.
Figure 2:
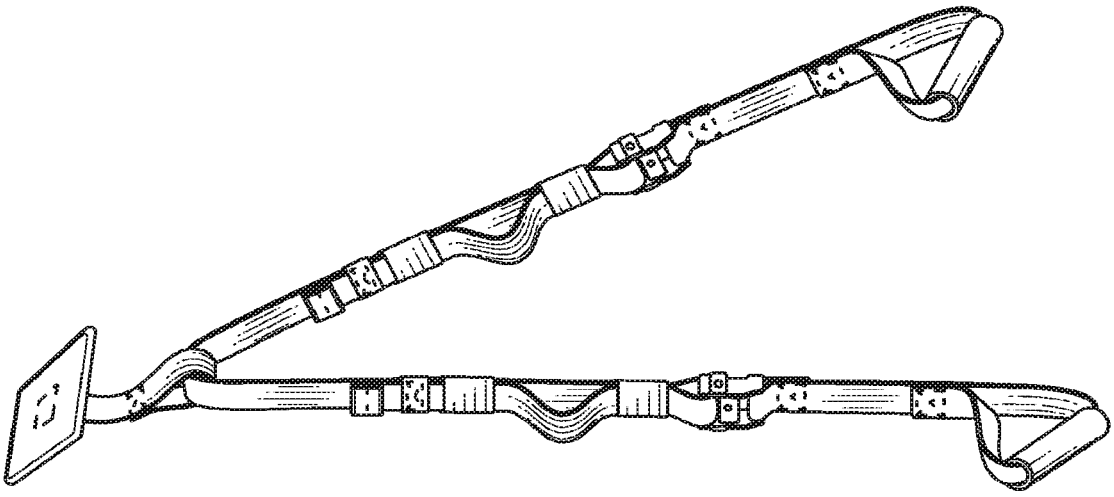
FIG. 2 (Prior Art)
FIG. 2 is an illustration taken from U.S. Pat. No. 7,090,622 from the prior art illustrating the technology generally known as SUSPENSION TRAINING®.
Figure 3:
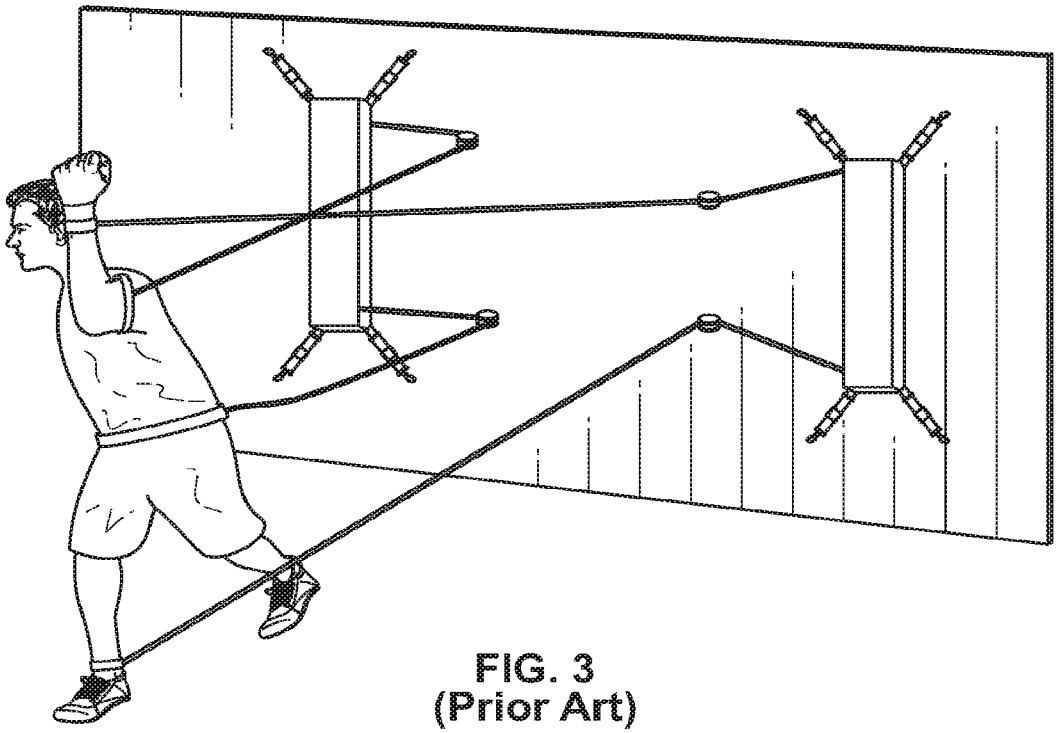
FIG. 3 (Prior Art)
FIG. 3 is an illustration taken from U.S. Pat. No. 9,802,072 illustrating a rope-based device for wall mounting from the prior art.
Figure 4:
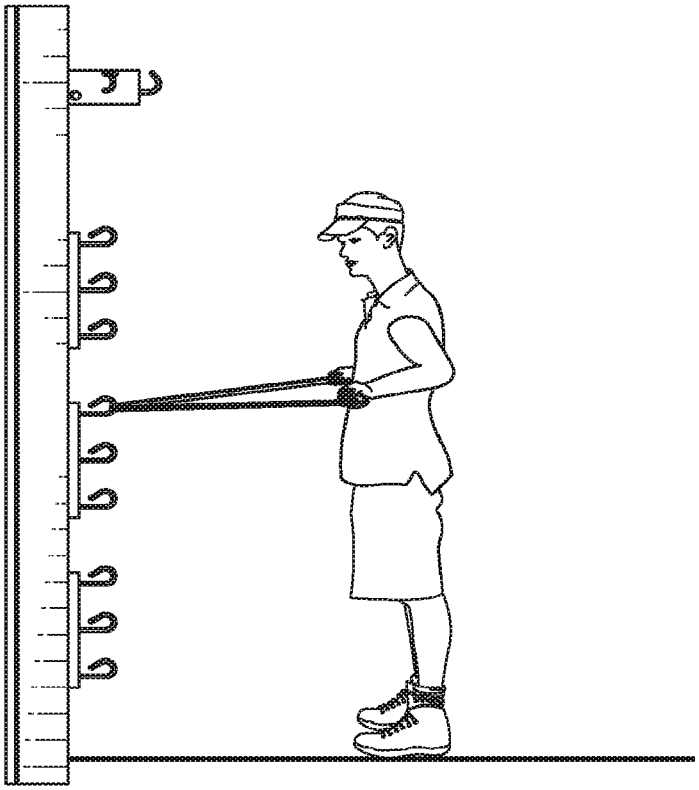
FIG. 4 (Prior Art)
FIG. 4 is an illustration taken from U.S. Pat. No. 9,050,493 illustrating a wall mounted device for use with deformable biasing elements also from the prior art.
Figure 5:
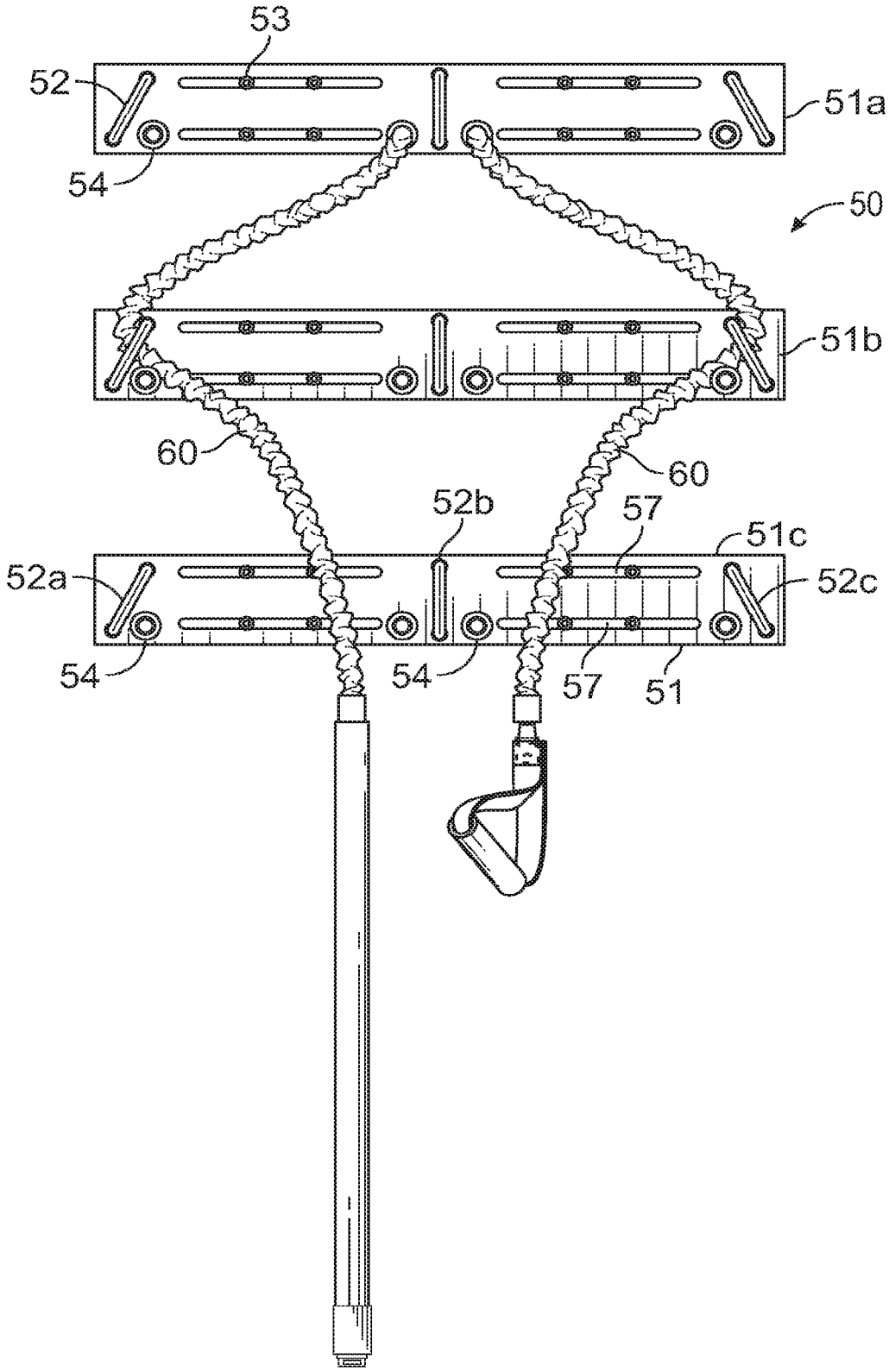
FIG. 5 is a view of the exercise system for using variable location anchors and variable biasing elements as mounted on a wall and having three mounting plates and where two types of exercise attachments are connected.

FIG. 5 is an isometric view of a wall mounted exercise system 50 illustrated with one mounting plate 51. As described and shown below, the system 50 can be used in association with any number and configuration of mounted plate 51 each having a number of different geometries. The mounting plate 51, as contemplated in this embodiment is described with greater detailed and illustrated at FIGS. 8-12. Generally speaking, the system relies on a network and group of quick-snap male and female connectors shown for example at FIGS. 21-23 to allow for best use dynamically in the context of a gym or any class setting where at different intervals. One of ordinary skill will recognize that the mounted plate 51 as shown are designed to be quickly mounted to any flat surface. But in the context of use, it is possible that the system 50 could be installed to any type of structure to be considered and viewed as the mounting plate or mounting point. For example, ISO containers are sold to the military which can be customized where the wall of the container itself or a single plate on the container can include, as shown part of the male and female connectors and the shortening elements 52. In still other examples, the mounting plate or mounting point can have other configurations that may not be a traditional planar plate but can have other shapes, cross-sections or other structures but still provide the mounting locations for the connectors, shortening elements and other aspects of the system 50 described herein. As shown at FIG. 5, a single mounting plate 51 may include three shortening elements 51*a*, 51*b*, and 51*c* located as shown. In other gyms, metallic structures are now attached and created that includes different shelving units, different anchoring points and other elements which allow for a commercial or residential surface to be transformed into a gym. For example, TRX® sells the TRX STUDIO LINE™ which is designed to transform an area into the place of use of the SUSPENSION TRAINING®. These areas can be updated to be used as the mounting plate 51 (one or more) upon which the other elements of the system 50 must be attached.

In one other embodiment, a kit can be offered and sold which includes multiple parts, such as the SUSPENSION TRAINING®, software access and classes/services related to the system 50, and/or other elements such as for example apparels, bags, the older version of the RIP TRAINER®. In another aspect, the system 50 or one or more of the mounting plates 51 can include a stand for holding a guide for exercising and using of the system. The stand (not shown) can have the form of a tray, sleeve, clip or other retention or support device that can hold a guide. The stand can be positioned so that the guide is conveniently located to be visible to a user of the system 50.

As shown in isometric view, the mounting plate 51 at FIGS. 7-12, in one embodiment, three identical or semi-identical mounting plates 51*a*, 51*b*, and 51*c* can be attached using fasteners 53, such as for example bolts, clamps, or other known elements in a horizontal fashion. As shown at FIG. 5, one is the upper mounting plate 51*a*, the second a central mounting plate 51*b*, and the third a lower mounting plate 51*c*. In another configuration (not shown), these three mounting plates 51*a*, 51*b*, and 51*c* can be placed vertically or in any orientation. In other configurations, different systems and configurations can be contemplated. Since each mounting plate 51 includes four (4) mating connectors 54, as shown at FIGS. 8-12, the connector on the mounting plate 51 are all male, this creates four possible points of attach of the biasing element 60 described hereafter. As shown, fixation bolts 53 can be used inside of u-shaped openings 57. Normally, because these mounting plates must hold the weight of a user or the force of a user exercising and pulling, these mounting plates are made of thick steel or other metal. In one embodiment, the steel plate 58 is approximately 3-5 mm thick and can be galvanized or painted. Other modes of attachment are also contemplated such as corners, L-shaped tabs, or encasings into a pre-formed structure.

Figure 12:
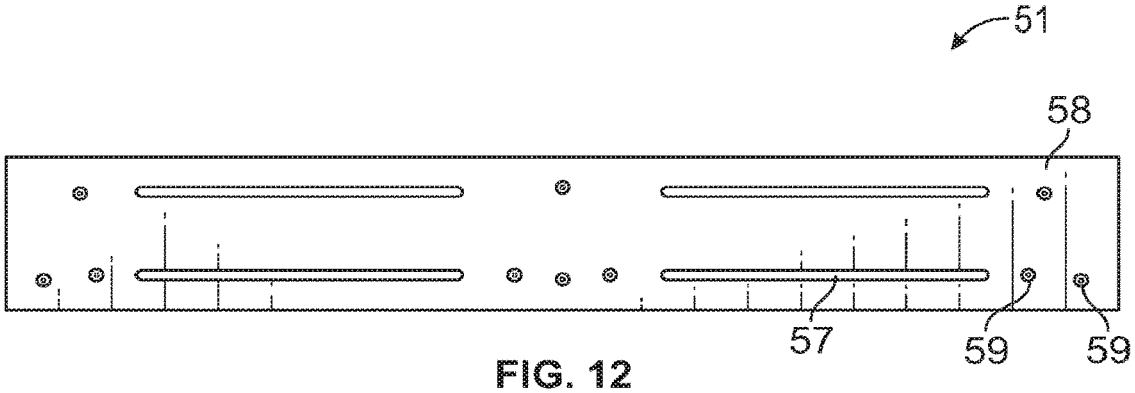
FIG. 12 is a back view of the mounting plate shown at FIG. 8.

As shown at FIGS. 8-12, the u-shaped openings 57 are wide and as close to the mating connectors 54 as possible. As the user exercises force on the different attached elements, strength may deform or bend the mounting plate 51. To limit any potential deformation or sheer forces, a user is encouraged during assembly to attach the mounting plate 51 with fixation points as close as each of the mating connectors 54. In addition, illustrated are shortening elements 52 in the shape of semi-circular stainless steel. In other examples, the shortening elements 52 can be a surface with friction rollers, a rope guide with funnel, a bearing based friction redactor or a Teflon®-coated transfer segment. In still other examples, the shortening elements 52 can be configured to have other shapes or structures such as eye bolts, openings integrally formed into the mounting plate 51 or other lobed features. FIG. 12 provides that in the back of the mounting plates, each of the elements (connectors 52, or shortening elements 52) may be attached using bolts 59.

Mating Connectors

Figure 18:
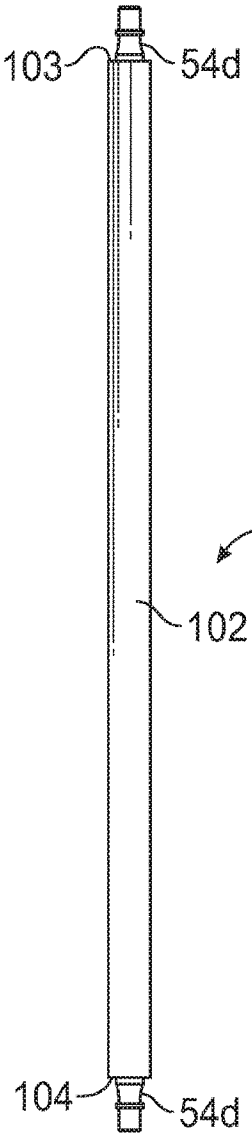
FIG. 18 is an isometric illustration of a first exercise attachment in the shape of a staff, as part of the exercise system for using variable location anchors and variable biasing elements shown at FIG. 5, according to an embodiment of the present disclosure.
Figure 21:
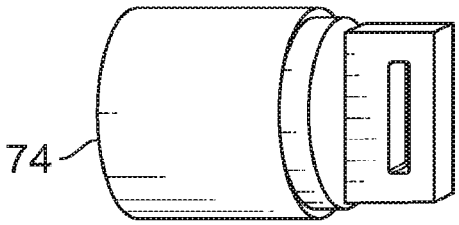
FIG. 21 is an isometric illustration of the female portion of a set of male and female quick-snap connectors used on different elements found in the exercise system for using variable location anchors and variable biasing elements shown at FIG. 5, according to an embodiment of the present disclosure.
Figure 22:
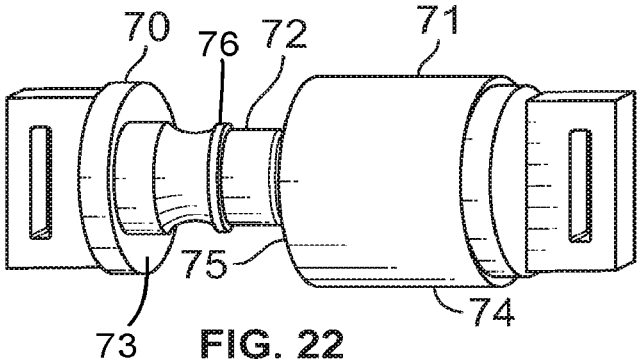
FIG. 22 is an illustration of an unconnected male and female quick-snap connectors used on different elements found in the exercise system for using variable location anchors and variable biasing elements shown at FIG. 5, according to an embodiment of the present disclosure.
Figure 23:
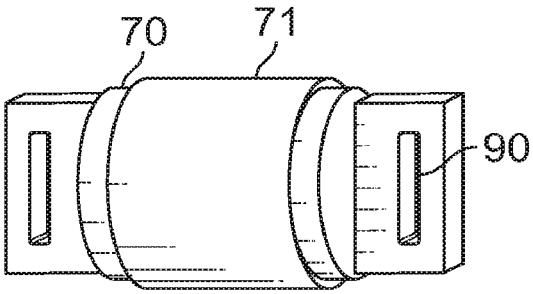
FIG. 23 is an illustration of the locked configuration of the male and female quick-snap connectors shown at FIG. 22.

One of the core concepts of the system 50 as shown is the notion that by using mating connectors shown at FIGS. 21-23 that are referred hereafter as "quick-snap" or "quick-connect" both a male 70 and female 71 connectors, the entire system 50 is designed to prevent a user from misusing the system 50. By way of "quick-snap" the inventor has created a positive male connector 70 in the shape of a rounded knob 72 as shown at FIG. 18. The female connector has an adaptor 74 where the male connector 70 is pushed in and a locking ring 75 powered by a biasing element (not shown) which a user will push down at the time of connection and then release with a "snap" when the product is locked back in. These "quick-snap" are designed to speed reconfiguration between different exercise or set-up and also provide a safety element to avoid disconnection during use. FIGS. 21-23 shown a mating "quick-connect" made of one male 70 and one female 71 element. In one embodiment, with the sale or purchase of the system 50, the inventor plans to include (if needed) spare parts to help a user with a client who may have damaged a connector to replace it locally. For example, in the gym context, some people lift weights of great weight. Even a very resistant male or female connector can be broken if the weight is dropped.

The male connector has a rounded tip 72 for insertion into the female connector and a retention lip 76. This lip 76 is designed to withstand the sheer forces of a pull. The locking ring 75 as shown is kept in the engaged position with a spring or another biasing element such as a plastic bent tab. Finger insertions (or releases) located at 180 degrees radially on the ring 75 allow a user with the thumb and another finger to push easily the finger insertions down allowing the coupling ring 75 to easily be placed and guided over the rounded tip 72 past the engagement tabs pushed outwardly by the finger insertions in a low position. Once the male connector is slid inside the female connector, by releasing the finger insertion(s), the engagement tabs close over the lip 76 completing the lock. The male connector also has a base 73 which serves to receive or connect with the upper segment of the locking ring 75. In addition, as currently contemplated, the connector is designed to lock in place and produce (without wear) a loud snapping sound to make sure the user understands the trusts the established connection. While one technology of male/female connection is shown and described, one of ordinary skill in the art will understand that what is contemplated is the use of any quick connect connector, such as for example simple carabineers and loops as the male and female connectors, the use of magnetic plates, the use of screw on systems, or even the use of a nesting plate (i.e. square, round) separated by a small space from the mounting plate 2 and a pairing flat plate that slides into the nesting plate. Also contemplated is the use of male or female openings made directly into the wall. Shown at 90 is the attachment of any piece of this system 50.

Biasing Element(s)

Figure 13:
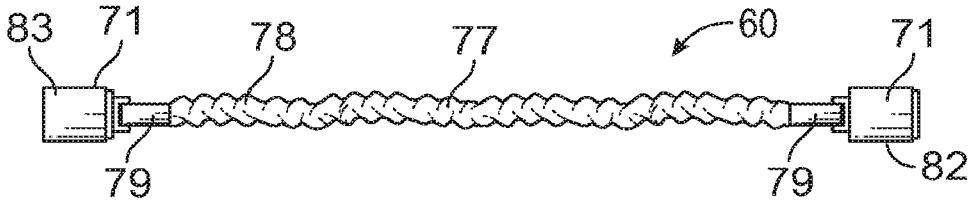
FIG. 13 is an illustrated view of one of the biasing elements in a non-extended configuration where both end include a female connector.
Figure 14:
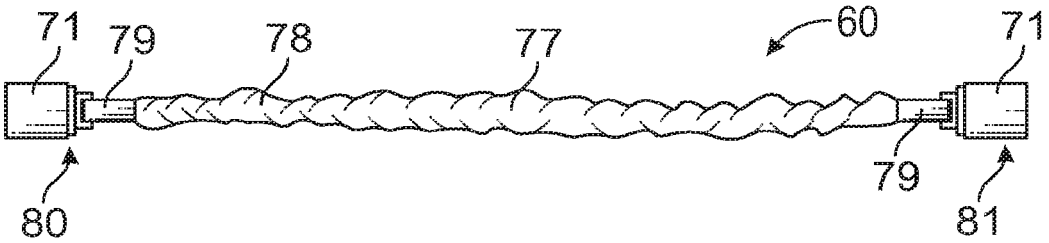
FIG. 14 is an illustrated view of the biasing element of FIG. 13 in an extended configuration.
Figure 15:
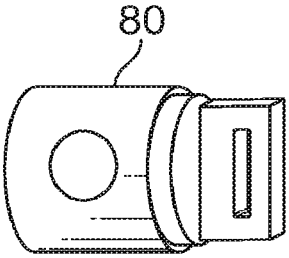
FIG. 15 is an illustration of a female quick-connect connector according to an embodiment of the present disclosure.
Figure 16:
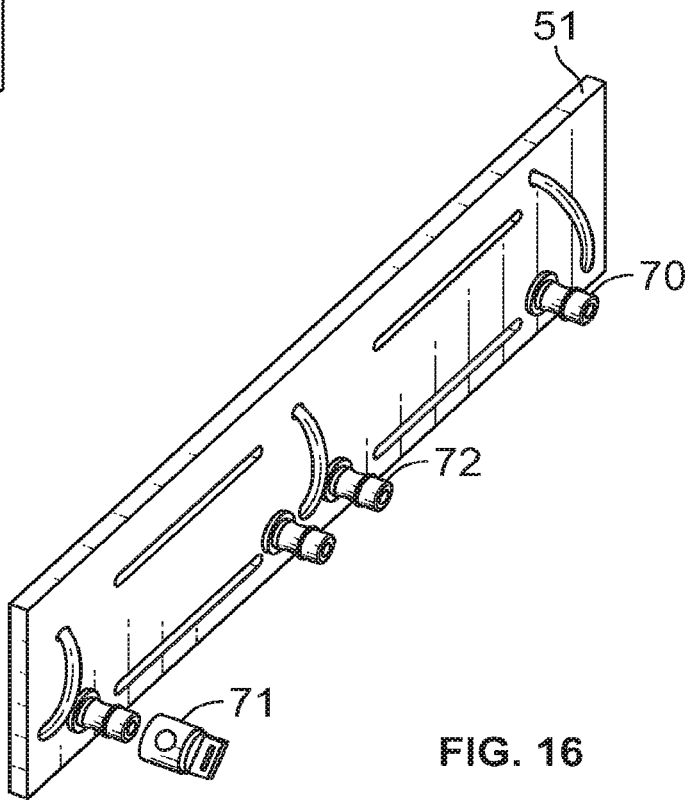
FIG. 16 is an illustration of the isometric mounting plate of FIG. 8 where the quick-connect connector of FIG. 15 is illustrated.
Figure 17:
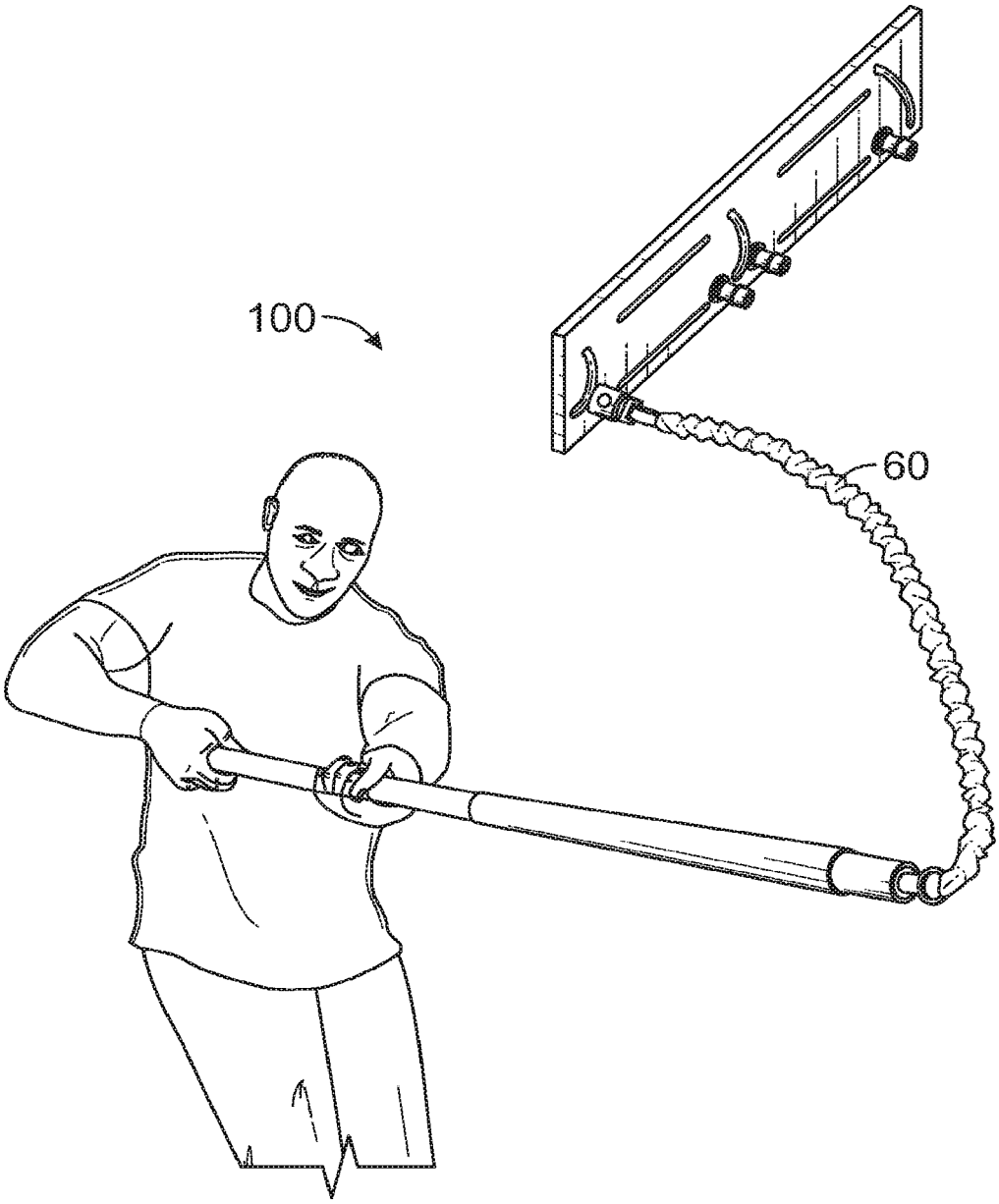
FIG. 17 is an illustration of the isometric mounting plate of FIG. 8 where the biasing element of FIG. 13 is connected as used according to an embodiment of the present disclosure.
Figure 20:
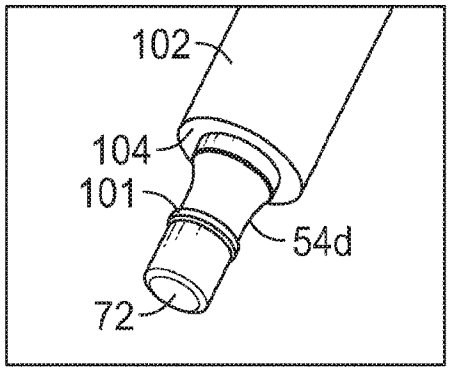
FIG. 20 is a close up view of either of the two ends of the first exercise attachment as shown at FIG. 18 showing the male connector.
Figure 19:
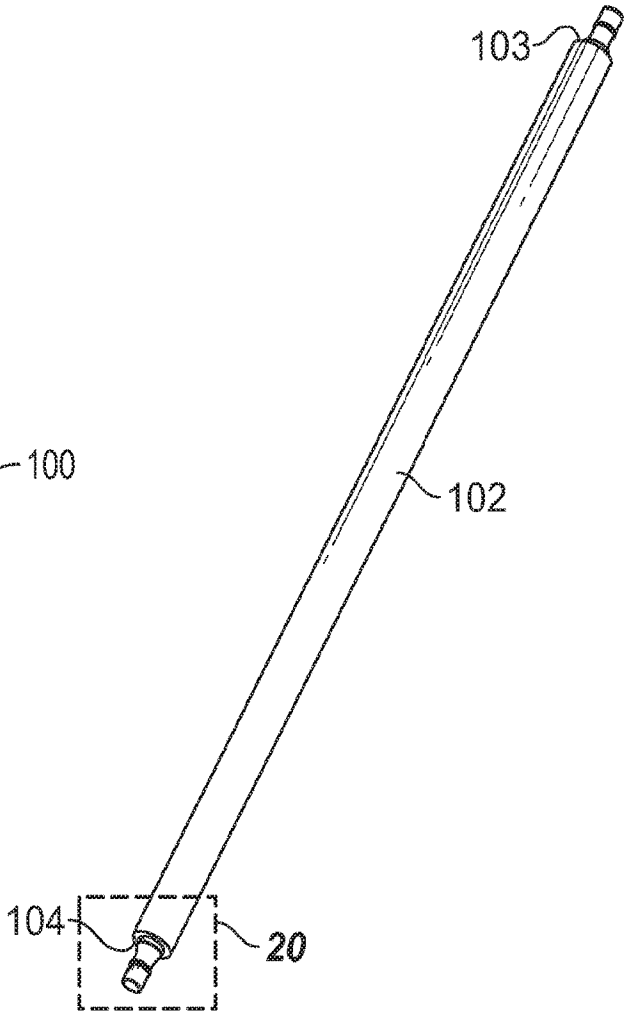
FIG. 19 is a top view of the first exercise attachment as shown at FIG. 18.

As shown at FIGS. 13-14, long biasing elements (aka nylon covered elastic bands) 77 are included in the system 50. This is shown, for example, at FIG. 5 as 60. One key feature of the invention is the notion that these biasing elements include a similar connector (e.g. two female 71 or two males 70) at each end as shown at FIGS. 13-14. This allows for the different exercise attachments (see below) to be connectable via the same connector as the mounting plate and avoid the desire by users to connect directly the exercise attachments to the mounting plate and bypassing the biasing elements which protects the system 50 from strain. The biasing element 60 includes an elastic body 77 which includes a polymer elastic band (not shown) over a nylon wrinkled non elastic shell 78. By attaching both the elastic band and the nylon wrinkled shell 78 at both extremities to each other by an attachment 79, this protects the elastic band from overstretching and breaking. This is the result of a slow extension of the elastic band under Hooke's Law until the maximum length of the nylon sleeve is reached. Once that is done, any additional stress or force put on the exercise attachment is no longer transferred into the band because under Hooke's law the band's length no longer changes.

Each of the ends of the biasing element 80, 81, includes a connector 82, 83 which can be interchanged to facilitate the connection and avoid placing a burden on the person using the system 50. At each end, a protector can be added in one embodiment to help protect the connectors and the stitching of the biasing element 60. While FIGS. 13-14 shown two biasing elements 60 the first at FIG. 13 having the same length but both extended differently. The first at FIG. 13 has less force and the second at FIG. 14 having a longer length has more force. While the system 50 is shown with two biasing elements 60 having the same length, this is only one possible configuration. Several biasing elements could be connected serially or different color/resistance biasing elements could be offered to adapt the system to different types of users. The use of colors to distinguish between different resistance or the use of numbers or other levels is equally contemplated. As part of the RIP TRAINER® technology, a simple carabineer is used along with an X-Mount® both from the inventor.

Another of the key features of this new system 50 is the use of longer biasing elements 60 which can be effectively shortened by slipping the end connector inside the semi-circular shortening elements 52 of the mounting plates 51. As shown at FIG. 5, each male connector 54 of the mounting plates 52*a, b, c* of the system 50 is located at an angle of one of the shortening elements 52 to facilitate the passage as illustrated of the biasing elements 60 inside the shortening elements 52. The way a surgeon prepares a stitch, the biasing element 60 can be passed under at least one or more of the semi-circular shortening elements 52. The effective goal is to change the length of the element and transform a length. Also, the semi-circular shortening element 52 allows for the body of the biasing element 60 to still move and/or slide and allow the element to lengthen or shorten during exercise. But the use of bends in this setting changes the effective force needed under Hooke's Law to include:

$$F=R+(k*\Delta L)$$

Where F is the force upon a user's body, R is a friction coefficient linked with the friction between the biasing element 60 and the shortening element 52. As one can imagine, the friction R changes with the angle of the biasing element 60 around the biasing element. For example, if the angle is 90 degrees the resistance may be X but if the exercise is conducted with the hand in the air instead of in front, the angle can be reduced and the effective resistance. In this manner, a resistance vector can be created at the end of the biasing element to change and/or modulate the resistance force and direction seen by the user of the system 50.

Exercise Attachments

Figure 6:
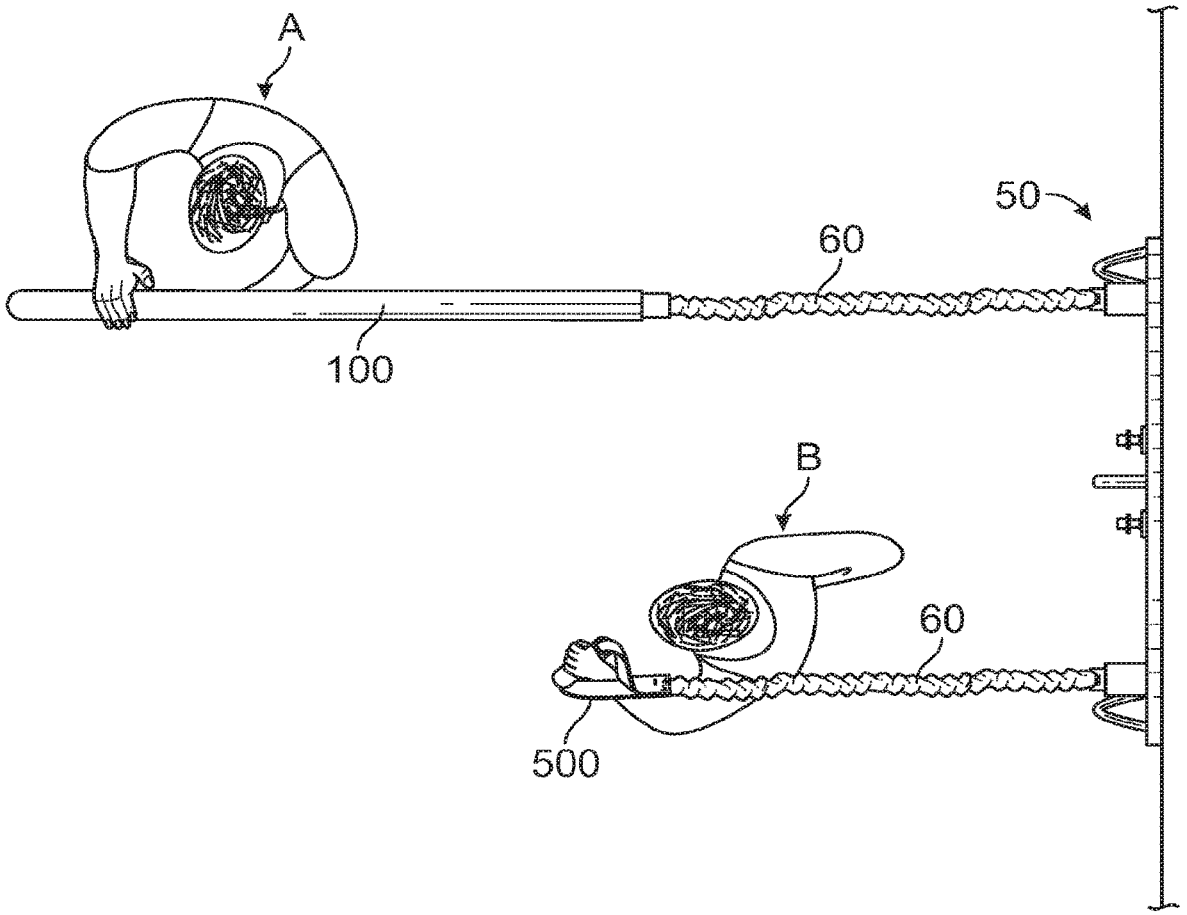
FIG. 6 is a top view of an area of exercise of the exercise system for using variable location anchors and variable biasing elements shown at FIG. 5 according to an embodiment of the present disclosure.
Figure 7:
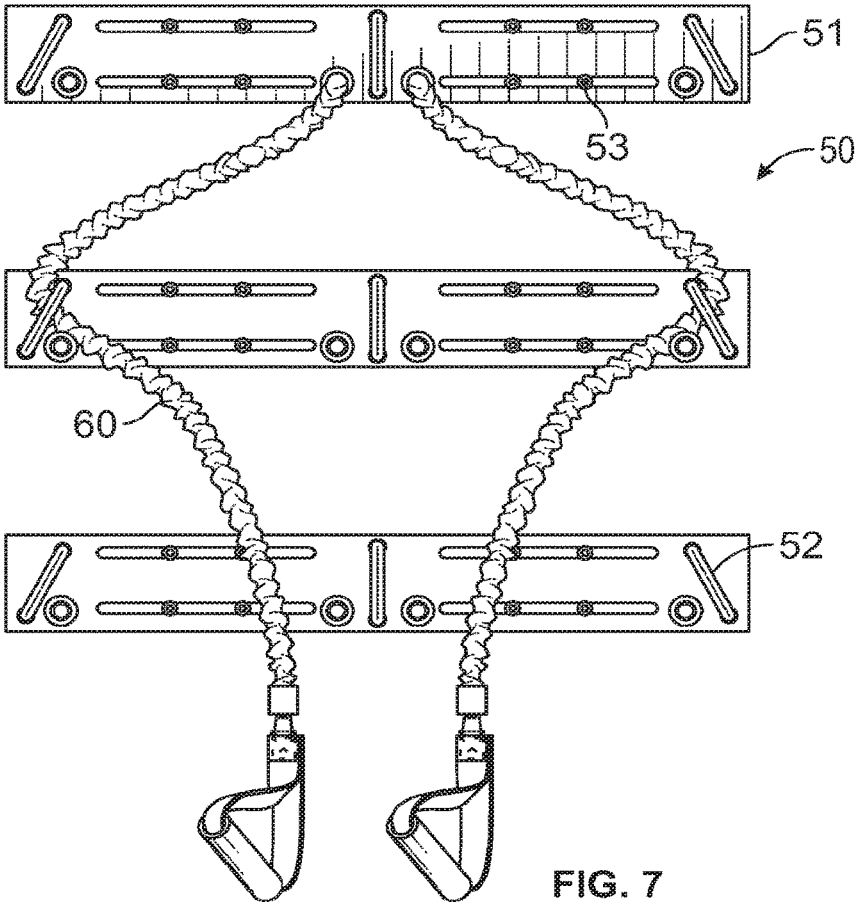
FIG. 7 is a view of the device as shown at FIG. 5 but where the two exercise attachments are identical.
Figure 8:
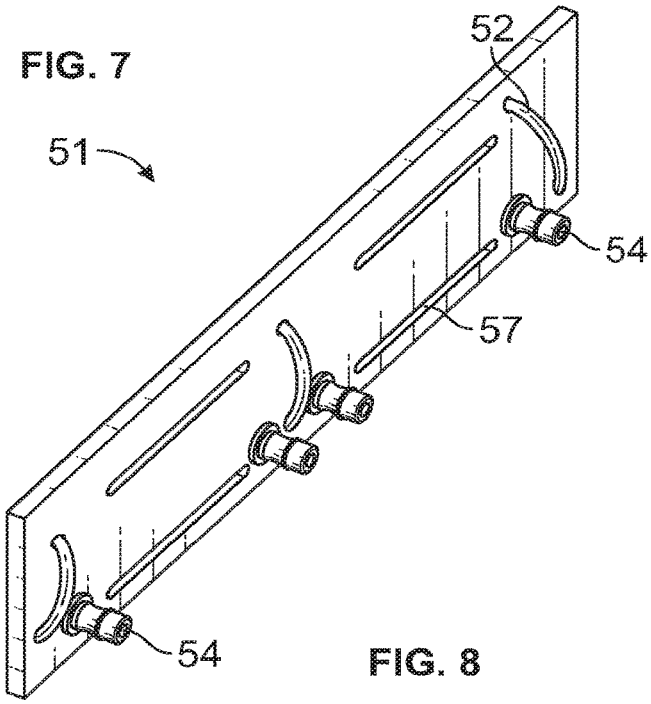
FIG. 8 is an isometric view of the mounting plate part of the exercise system shown at FIG. 5 according to an embodiment of the present disclosure.
Figure 9:
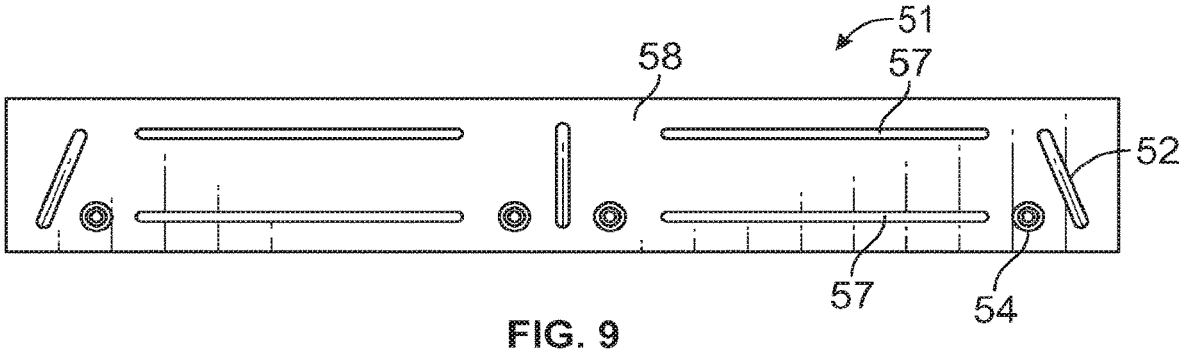
FIG. 9 is a front view of the mounting plate shown at FIG. 8
Figure 10:
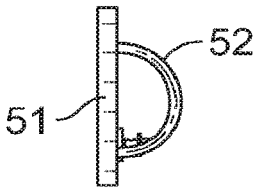
FIG. 10 is a side view of the mounting plate shown at FIG. 8.
Figure 11:
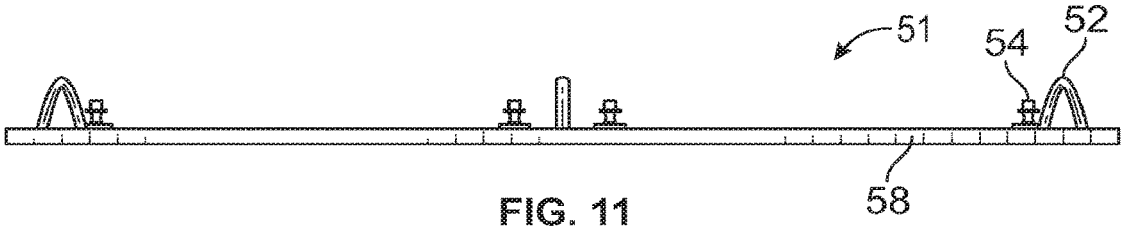
FIG. 11 is a bottom view of the mounting plate shown at FIG. 8.

FIG. 6 illustrates the system 50 in use by two users A, B, where each user is exercising only with one attachment. User A uses the first attachment 100. User B uses the fifth attachment 500 as described below. Each is connected via a biasing element 60 and the different end connectors. By exercise attachments, what is shown is any piece, which can be connected via a male connector 70 on the exercise attachment 100, 200, 300, 400, and 500 to the biasing element 60 at the end 81. While the current system is designed with the greatest flexibility, the inventor also understands that these attachments 100, 200, 300, 400, and 500 or any other could be directly coupled to a biasing element 60 without the connector. This would not change the spirit and nature of the invention but only make a system 50 more costly and require more volume to operate. The inventor understands the need for adaptability, change and variability as part of the system 50. In addition, the inventor created a new system 50 designed to precisely adapt to multiple types of users, multiple types of exercises, in multiple context. Hereafter is described five possible exercise attachments as a first exercise attachment 100 (FIGS. 17-20), a second exercise attachment 200 (FIGS. 24-25), a third exercise attachment 300 (FIGS. 26-27), a fourth exercise attachment 400 (FIGS. 28-29), and a fifth exercise attachment 500 (FIGS. 30-31).

The first exercise attachment is a long staff 101 that may be in a single piece or two-pieces. In one embodiment, both ends include a male connector 102, 103, where one is to be connected to one of the female connectors of the biasing element. The other male connector, for example, can be connected to the female mating connector shown at FIGS. 13-16. The staff can be covered by textured grips for better use or by antimicrobial polymer designed to help the first attachment 100 with long term use problems. As shown at FIGS. 13-16, the staff 101 is covered with a single grip 104. What is not shown but also contemplated is the use of two biasing elements 60 each connected to a different portion of the mounting plates 51 and each connected to a different end of the staff 101. This allows a user to stand in the polygon created by the staff, the two biasing elements 60 and the vertical wall to conduct an exercise. This also doubles the resistance force against the wall.

Figure 30:
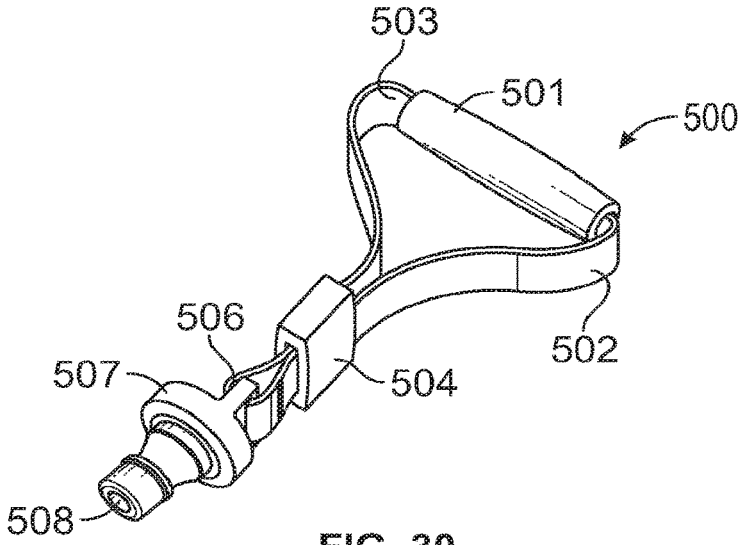
FIG. 30 is an isometric view of a fifth exercise attachment in the shape of a handle, as part of the exercise system for using variable location anchors and variable biasing elements shown at FIG. 5, according to an embodiment of the present disclosure.
Figure 31:
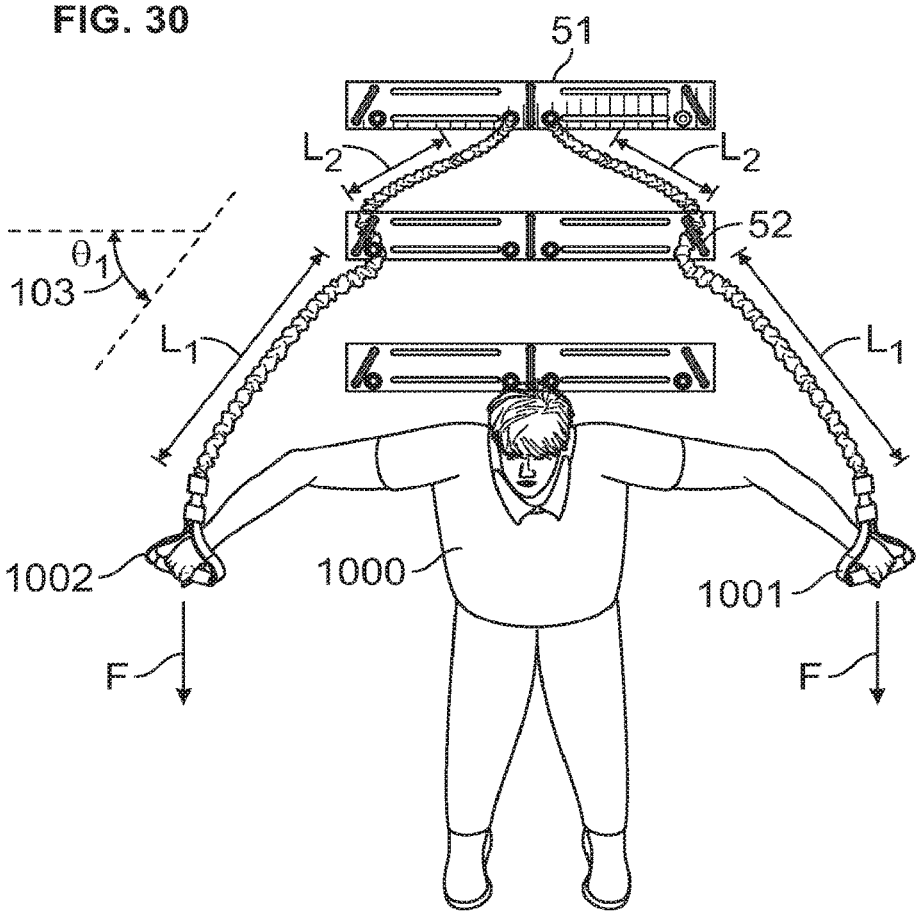
FIG. 31 is an illustrated view of a user using the exercise system for using variable location anchors and variable biasing elements shown at FIG. 5 in conjunction with the fifth exercise attachment.

The fifth exercise attachment 500 as shown at FIG. 30, is a tube-like handle covered by ribbed rubber 501, two side reinforcement rings 502, 503, where a single strap 506 passes through the handle 501 and is stitched under a protector 504. As shown, the protector is made of a thick polymer and can include a branding element. Above the protector is a connector to the male connector 507 used to be connected to one of the two female connectors of the biasing element. One handle 500 is part of the system 50 in a first configuration as illustrated at FIG. 5 but in the field of exercise, some regimen requires the engagement of both symmetrical muscles on a body and requires two handles while other exercises may only require alternate engagement of these same muscles. As part of FIG. 31, a user 1000 is engaging both handles 1001, 1002 and two biasing elements over a wall. In this configuration, three horizontal mounting plates 51 are attached to a wall. The biasing element are connected to the two central male connectors of the top mounting plate 51, and then passed under and around the shortening elements 52, located on the central horizontal mounting plate. In that illustrated example, the length and the resistance of the biasing elements are repositioned and repurposed to the specific desire.

Returning to FIG. 6, what is shown is a top view of an area of exercise zone of the exercise system 50 for using variable location anchors and variable exercise attachments. As shown, two users A, B are located in front of the wall. As illustrated, two people can use the system 50 but also in some exercise, one person can use the system 50 alone.

Figure 24:
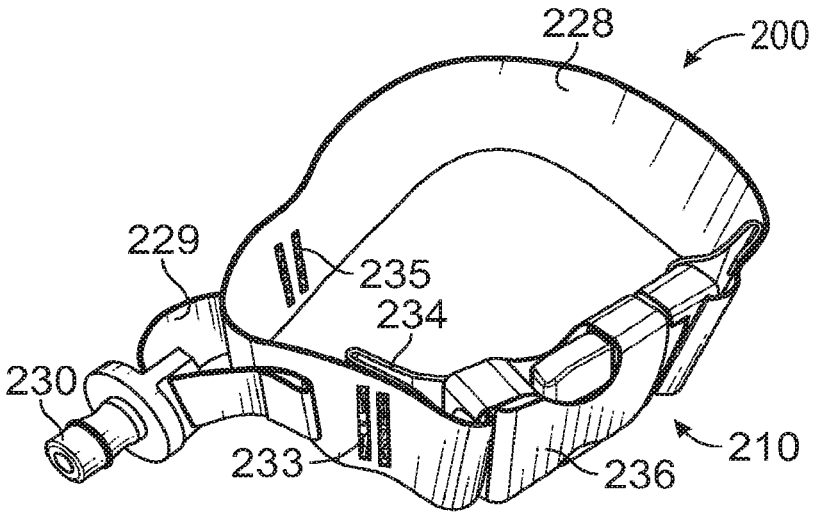
FIG. 24 is an isometric view of a second exercise attachment in the shape of a loop with buckle in a closed configuration, as part of the exercise system for using variable location anchors and variable biasing elements shown at FIG. 5, according to an embodiment of the present disclosure.
Figure 25:
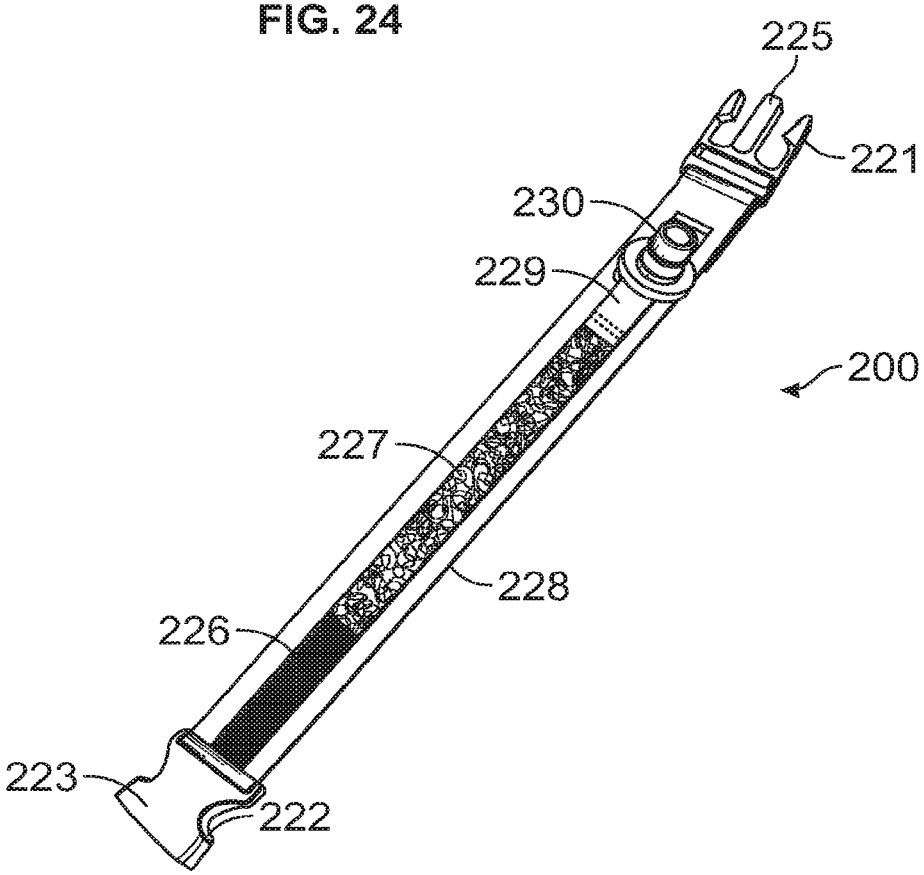
FIG. 25 is a view of the second exercise attachment from FIG. 24 but shown in an open configuration, according to an embodiment of the present disclosure.

The second exercise attachment 200 as shown at FIGS. 24-25, is a flat inelastic strap in the shape of a loop with buckle. The strap 228 includes a male and female buckle 221, 222, and a piece 229 for securing and holding the male connector 230. The second exercise attachment 200 can be circled around a wrist, a leg, or even an ankle. The strap 228 can be adjusted using releasable mating fastener elements 226, 227 to shorten or lengthen the size of the loop that is defined when the opposite ends of the strap 228 are joined together using the male and female buckle 221, 222. As can be appreciated, the connector 230 can slide along the piece 229 that secures the male connector 230 to the strap 228. As such the second exercise attachment can be used in any number of configurations while maintaining a secure connection to the system 50. As further shown, the second exercise attachment 200 can include multiple sets of parallel-oriented stitches 235, 233.

Figure 26:
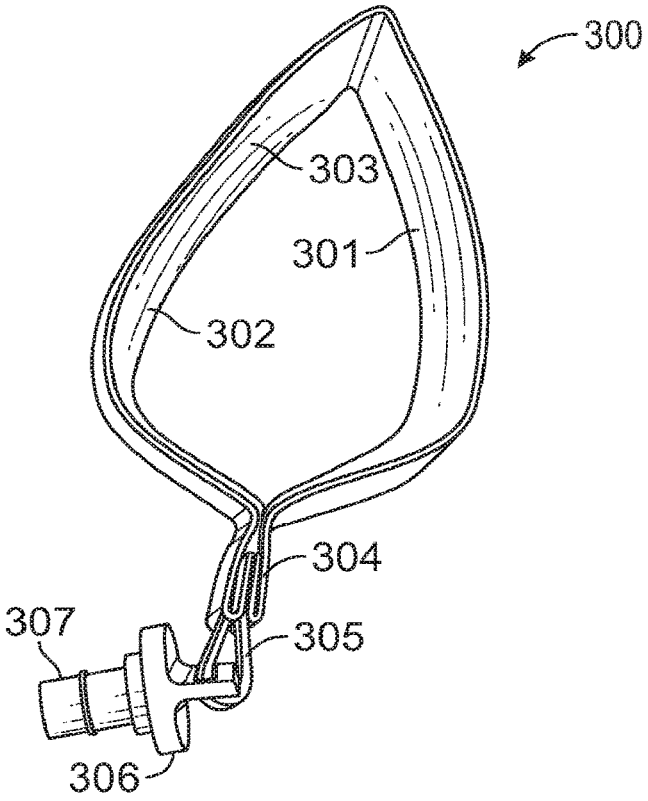
FIG. 26 is an isometric view of a third exercise attachment in the shape of a closed loop, as part of the exercise system for using variable location anchors and variable biasing elements shown at FIG. 5, according to an embodiment of the present disclosure.
Figure 27:
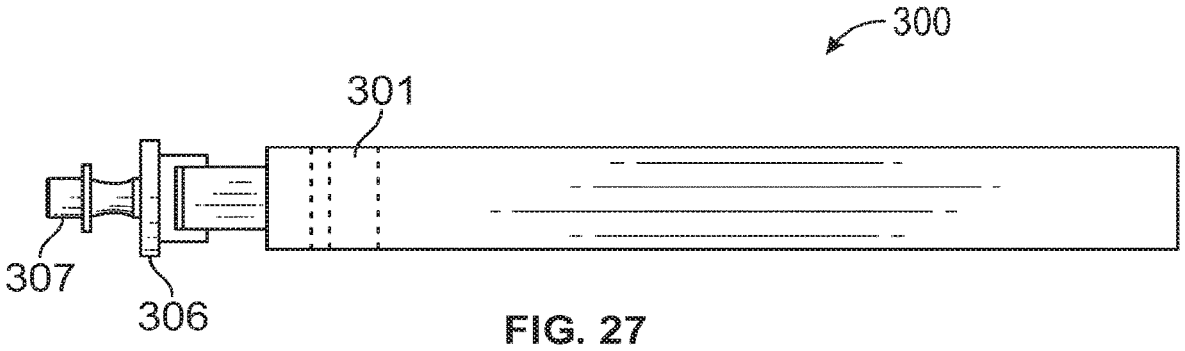
FIG. 27 is a side view of the third exercise attachment shown at FIG. 26 according to an embodiment of the present disclosure.

FIGS. 26-27 are views of a third exercise attachment 300. The third exercise attachment 300 is in the shape of a closed loop, as part of the exercise system for using variable location anchors and variable biasing elements shown at FIG. 5, according to an embodiment of the present disclosure. As shown, a simple closed loop 301 is made of padded nylon 303 stitched 304 closed and connected to a male connector 306 using an attachment 305. This third attachment 300, while having certain similarities with the second attachment 200 has additional functions. For example, in the case where two biasing elements 60 are to be used on a single wrist of a user, the person might prefer using two softer wraparounds 300 to prevent chafing or abrasions from occurring on the user's body.

Figure 28:
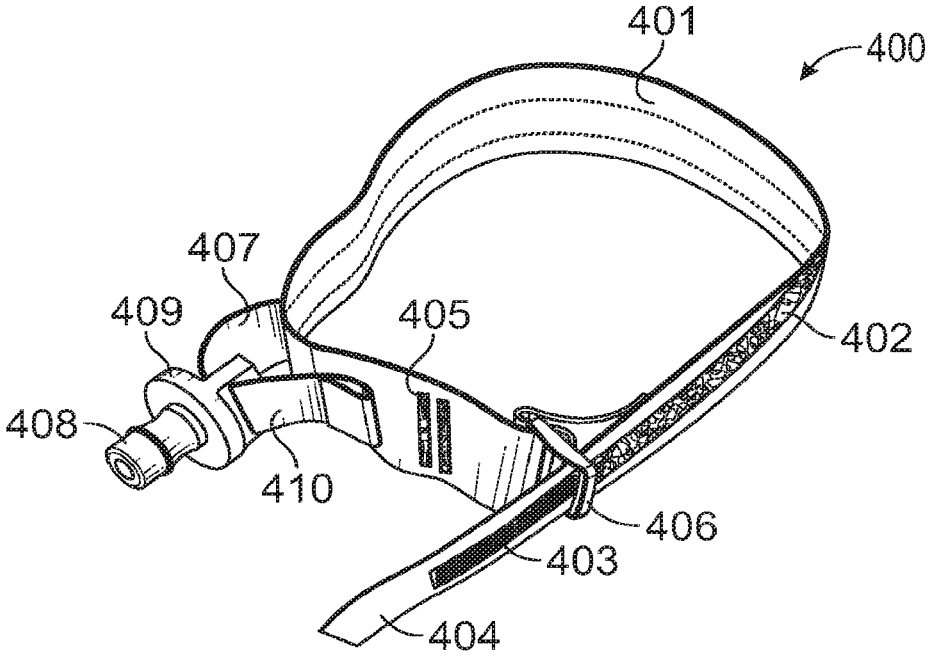
FIG. 28 is an isometric view of a fourth exercise attachment in the shape of a hook and fastener loop, as part of the exercise system for using variable location anchors and variable biasing elements shown at FIG. 5 in a closed configuration, according to an embodiment of the present disclosure.
Figure 29:
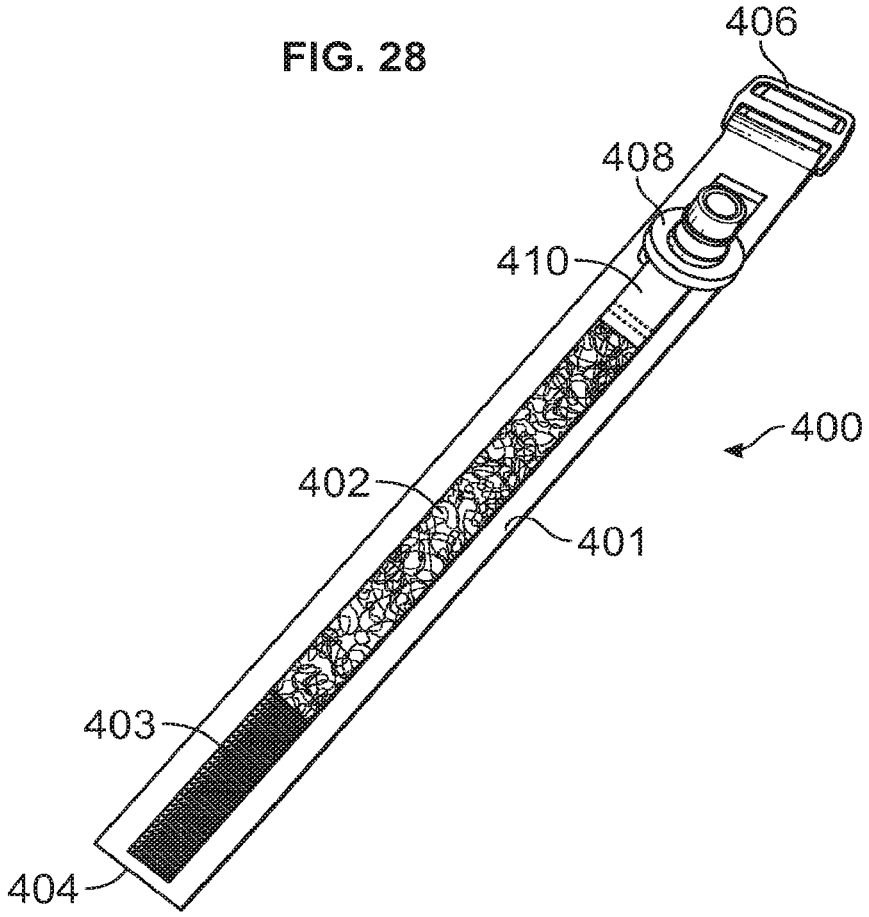
FIG. 29 is an isometric view of the fourth exercise attachment shown at FIG. 28 but in an open configuration.

FIGS. 28-29 are views of a fourth exercise attachment 400 in the shape of a hook and fastener loop 401, as part of the exercise system 50 for using variable location anchors and variable biasing elements shown at FIG. 5. This attachment 400 also includes a male connector 409, attached to the loop 401 by a strip of non-elastic nylon 410 but it includes on the outside a strip of hook and fasteners 402, 403 (aka Velcro®). To close this easily adjustable attachment, the tip 404 is passed in the opened end of a buckle 406 and flipped back for closure. While these adjustable closures take more time to put in place and close, they do avoid space between the body part and the attachment. In turn, this often limits any friction or damage to the skin. As also shown, the fourth exercise attachment 400 (or any other example exercise attachments) includes a set of parallel-oriented stitches 405.

The invention claimed is:

1. An exercise system for performing exercises adjacent to a surface by at least a user by creating a resistance force in a portion of a user's body by pulling at least one exercising element away from the surface, the system comprising:

first and second mounting points fixed on the surface, each of the first and second mounting points including at least one closed-loop structure defining an opening and a first mating connector;

a biasing element comprising a proximate end and a distal end and a length therebetween, the biasing element configured to pass through the opening of the closed-loop structure on one of the first and second mounting points, the distal end removably coupled to the first mating connector on one of the first and second mounting points; and at least one user interface removably coupled to the proximate end of the biasing element;

wherein an intermediate portion of the biasing element located between the proximate end and the distal end is configured to slide in the closed-loop structure and serves to alter a resistance vector at the user interface during use and wherein the first mating connector comprises one of a male connector or a female connector, and the user interface includes the other of the male connector or female connector to allow the user interface to releasably connect to the one of the first and second mounting points.

2. The exercise system of claim 1, wherein the first and second mounting points comprise first and second mounting plates, respectively.

3. The exercise system of claim 2, further comprising a third mounting point comprising a third mounting plate to form a three by three matrix of anchor points.

4. The exercise system of claim 3, wherein the surface is a vertical wall and the mounting plates each include an attachment for securing each plate to the vertical wall either horizontally or vertically.

5. The exercise system of claim 1, wherein the user interface is selected from a group comprising, a strap based exercise trainer device, a strap-based handle, a partly wooden handle, a loop with a carabineer, a belt attachment, and a shoulder strap attachment.

6. The exercise system of claim 1, wherein the closed-loop structure for sliding movement of the biasing element is selected from the group of a smooth rounded surface, a surface with friction rollers, a rope guide with funnel, a bearing-based friction redactor, a Teflon®-coated transfer segment.

7. The exercise system of claim 3, further comprising a plurality of biasing elements each adapted to be removably coupled to different locations on the mounting points.

8. The exercise system of claim 1, further including a stand for holding a guide for exercising and using of the system.

9. An exercise system for performing exercises adjacent to a surface by at least a user by creating a resistance force in a portion of a user's body by pulling at least one exercising element away from the surface, the system comprising:

first and second mounting points fixed on the surface, each of the first and second mounting points including at least one closed-loop structure defining an opening and a first mating connector;

a biasing element comprising a proximate end and a distal end and a length therebetween, the biasing element configured to pass through the opening of the closed-loop structure on one of the first and second mounting points, the distal end removably coupled to the first mating connector on one of the first and second mounting points; and at least one user interface removably coupled to the proximate end of the biasing element;

wherein an intermediate portion of the biasing element located between the proximate end and the distal end is configured to slide in the closed-loop structure and serves to alter a resistance vector at the user interface during use and wherein the first mating connector comprises a rounded knob that projects out from the one of the first and second mounting points and the biasing element includes a complimentary mating connector at the distal end, the complimentary mating connector comprising an adapter configured to accept the rounded knob and releasably connect thereto.

10. The exercise system of claim 9, wherein the first and second mounting points comprise first and second mounting plates, respectively.

11. The exercise system of claim 10, further comprising a third mounting point comprising a third mounting plate to form a three by three matrix of anchor points.

12. The exercise system of claim 11, wherein the surface is a vertical wall and the mounting plates each include an attachment for securing each plate to the vertical wall either horizontally or vertically.

13. The exercise system of claim 9, wherein the user interface is selected from a group comprising, a strap based exercise trainer device, a strap-based handle, a partly wooden handle, a loop with a carabineer, a belt attachment, and a shoulder strap attachment.

14. The exercise system of claim 9, wherein either the first mating connector comprises one of a male connector or a female connector, and the user interface includes the other of the male connector or female connector to allow the user interface to releasably connect to the one of the first and second mounting points.

15. The exercise system of claim 9, wherein the closed-loop structure for sliding movement of the biasing element is selected from the group of a smooth rounded surface, a surface with friction rollers, a rope guide with funnel, a bearing-based friction redactor, a Teflon®-coated transfer segment.

16. The exercise system of claim 11, further comprising a plurality of biasing elements each adapted to be removably coupled to different locations on the mounting points.

17. The exercise system of claim 9, further including a stand for holding a guide for exercising and using of the system.

* * * * *